US007806204B2

(12) United States Patent
Oothoudt

(10) Patent No.: US 7,806,204 B2
(45) Date of Patent: Oct. 5, 2010

(54) SONIC DRILL ROD WITH EXTERNAL SURFACE FEATURES

(75) Inventor: Thomas J. Oothoudt, Little Falls, MN (US)

(73) Assignee: Longyear TM, Inc., South Jordan, UT (US)

( * ) Notice: Subject to any disclaimer, the term of this patent is extended or adjusted under 35 U.S.C. 154(b) by 104 days.

(21) Appl. No.: 12/260,800

(22) Filed: Oct. 29, 2008

(65) Prior Publication Data

US 2010/0101863 A1 Apr. 29, 2010

(51) Int. Cl.
*E21B 17/22* (2006.01)
*E21B 10/02* (2006.01)

(52) U.S. Cl. ..... 175/57; 175/323; 175/403; 175/56

(58) Field of Classification Search ..... 175/56, 175/57, 323, 403, 405
See application file for complete search history.

(56) References Cited

U.S. PATENT DOCUMENTS

| | | | | | |
|---|---|---|---|---|---|
| 2,831,659 | A * | 4/1958 | Kukuchek et al. | ..... | 175/323 |
| 3,095,051 | A * | 6/1963 | Robinsky et al. | ..... | 175/270 |
| 3,360,960 | A * | 1/1968 | Massey | ..... | 464/183 |
| 3,651,876 | A * | 3/1972 | Henson | ..... | 175/323 |
| 3,794,127 | A * | 2/1974 | Davis | ..... | 175/58 |
| 3,888,320 | A * | 6/1975 | Maxwell | ..... | 175/394 |
| 4,403,665 | A * | 9/1983 | Bodine | ..... | 175/55 |
| 4,460,202 | A * | 7/1984 | Chance et al. | ..... | 285/333 |
| 4,465,146 | A * | 8/1984 | Fitch | ..... | 175/61 |
| 4,484,642 | A * | 11/1984 | Evans | ..... | 175/65 |
| 4,699,226 | A * | 10/1987 | Muller et al. | ..... | 175/323 |
| 4,811,800 | A * | 3/1989 | Hill et al. | ..... | 175/323 |
| 4,912,415 | A * | 3/1990 | Sorensen | ..... | 324/347 |
| 4,942,932 | A * | 7/1990 | Bracewell | ..... | 175/323 |
| 4,949,797 | A * | 8/1990 | Isom | ..... | 175/317 |
| 5,040,622 | A * | 8/1991 | Winship et al. | ..... | 175/323 |
| 5,042,600 | A * | 8/1991 | Finnegan et al. | ..... | 175/323 |
| 5,562,169 | A * | 10/1996 | Barrow | ..... | 175/56 |
| 5,788,401 | A | 8/1998 | Drenth | | |
| 6,109,620 | A | 8/2000 | Roberts et al. | | |
| 6,196,598 | B1 | 3/2001 | Yao | | |
| 7,448,832 | B2 | 11/2008 | Annanolli et al. | | |
| 7,631,705 | B1 * | 12/2009 | Harte et al. | ..... | 175/59 |
| 2002/0129975 | A1 * | 9/2002 | Barta | ..... | 175/18 |

OTHER PUBLICATIONS

U.S. Appl. No. 12/346,395, filed Dec. 30, 2008, Oothoudt.

* cited by examiner

*Primary Examiner*—Shane Bomar
(74) *Attorney, Agent, or Firm*—Workman Nydegger

(57) ABSTRACT

Drill rods and systems for use in drilling processes, as well as methods for making and using such drill rods and systems. A drill rod configured for sonic drilling operations can include a cylindrical body having an interior surface and an exterior surface. A first connector may be located on a first end of the cylindrical body and a second connector may be located on a second end of the cylindrical body. The first connector and the second connector can be complementary. The drill rod can include a helical feature and a corresponding helical channel on the exterior surface of the cylindrical body. The helical feature and corresponding helical channel can be configured for moving material displaced during a drilling operation in an axial direction away from one end of the drill rod to the other.

32 Claims, 4 Drawing Sheets

SONIC DRILL ROD WITH EXTERNAL SURFACE FEATURES

BACKGROUND OF THE INVENTION

1. Technical Field

This application relates generally to drill rods and methods of making and using such drill rods. In particular, this application relates to drill rods used in sonic core drilling processes.

2. Background and Relevant Art

In sonic core drilling processes, variable frequency vibration is created by an oscillator. The vibration is then mechanically transferred to the drill string of the core barrel and/or casing. The vibration is transmitted in an axial direction down through the drill string to an open-faced drill bit. As a result, the drill string may be rotated and/or mechanically pushed as it is vibrated into the sub-surface formation.

Often, sonic core drilling processes are used to retrieve a sample of material from a desired depth below the surface of the earth. In one conventional sonic drilling process, an open-faced drill bit is attached to the bottom or leading edge of a core barrel. The core barrel is attached to the bottom of a drill string, which is a series of individually threaded and coupled drill rods that are assembled section-by-section as the depth of the borehole increases. The top of the drill string is then coupled to a sonic drill head. The sonic drill head may include high-speed, rotating counterbalances that produce resonant energy waves and a corresponding high-speed vibration to be transmitted through the drill string to the core barrel. As a result, the sonic drill head can vertically vibrate the core barrel. In addition, the drill head can rotate and/or push the core barrel into the sub-surface formation to obtain a core sample. Once the core sample is obtained, the core barrel (containing the core sample) is retrieved by removing (or tripping) the entire drill string out of the borehole that has been drilled. Once retracted to the surface, the core sample may then be removed from the core barrel.

In addition, an outer casing with a larger diameter than the core barrel may be used to maintain an open borehole. Like the core barrel, the casing may attach to an open-faced drill bit at a lower end, and to a drill head at an upper end. The outer casing may be advanced and removed in the same manner as the core barrel. For example, the casing can be advanced into a formation one drill rod at a time using a drill head. Similarly, the casing can be removed by tripping the drill rods of the outer casing out of the borehole.

In contrast, in a sonic wireline drilling process, the core barrel and the casing are advanced together into the formation. The casing again has an open-faced drill bit and is advanced into the formation. However, the core barrel (inner tube) does not contain a drill bit or connect to a drill string. Instead, the core barrel mechanically latches inside of and at the bottom of the casing and advances into the formation along with the casing. When the core sample is obtained, a drill operator can retrieve the core barrel using a wireline system. Thereafter, the drill operator can remove the core sample from the core barrel at the surface, and then drop the core barrel back into the casing using the wireline system. As a result, the wireline system eliminates the time needed to trip the drill rods and drill string in and out of a borehole for retrieval of the core sample.

Both conventional and wireline sonic drilling processes include serious drawbacks. One of which, is that the drilled material at and ahead of the bit face has to be displaced. The bit face material will typically take the path of the least resistance. The displaced material can enter the core barrel, which can disturb, elongate, compact, and, in some cases, heat the core samples. The drilled material can be pushed outward into the formation, which can cause compaction of the formation and alter its natural state. Furthermore, the drilled material can enter the annular space between the outer casing and the borehole wall, which can cause increased friction and/or heat and bind the casing or core barrel in the borehole.

In addition, when drilling hard and/or dry formations, the displaced material often cannot move anywhere, so it is re-drilled numerous times creating additional heat, drilling inefficiencies, and bound/stuck casings. When a casing binds or sticks, the drilling process may be slowed or stopped altogether. In addition, a bound or stuck casing may require the use of a flushing medium, such as water, mud, or air, to remove the excess material and free up the casing. However, the addition of a flushing medium is often undesirable because it can cause sample disturbance and borehole contamination.

BRIEF SUMMARY OF THE INVENTION

Implementations of the present disclosure overcome one or more problems in the art with systems, methods, and apparatuses used for sonic core drilling processes. In particular, the present disclosure extends to sonic drilling systems including a drill rod with external features configured for transporting drilled material away from the drill bit to improve drilling efficiencies, penetration rates, and core sample quality. For example, in at least one example embodiment, a drill rod used in sonic drilling can comprise helical features along the exterior surface of the drill rod. The helical features can be configured for transporting material in an axial direction away from a bit face and towards the surface or opening of a borehole. This design can allow for improved and more efficient drilling, including the ability to collect highly-representative, minimally-disturbed core samples.

A drill rod can be configured for sonic drilling operations. The drill rod can include a hollow cylindrical body having an interior surface and an exterior surface. The cylindrical body can have a first end with a first connector and a second end with a second connector. In particular, the first connector and second connector can be complementary. In addition, the drill rod can include a helical feature and a corresponding helical channel on the exterior surface of the cylindrical body. In at least one embodiment, the helical feature and helical channel can be configured to move material displaced during a drilling operation in an axial direction away from one end of the drill rod to another.

A system for sonic core drilling, in accordance with at least one example embodiment, can comprise a drill rig including a sonic drill head. The sonic drill head can couple to a drill string comprising one or more drill rods. In particular, at least one drill rod can comprise a helical feature and/or a helical channel extending along a portion of its outer surface. In turn, the drill string can couple to a drill bit at one end. In a further embodiment, the helical feature and/or helical channel can be configured to translate drilled material in an axial direction away from the drill bit during a drilling process.

A method of drilling can include connecting a first drill rod having at least one helical feature on the outer surface of the drill rod to an additional drill rod to form a drill string. Specifically, the helical feature of the first drill rod can be configured to move material displaced during drilling in an axial direction away from the drill bit. A first end of the drill string can be connected to a drill bit and a second end of the drill string can be connected to a sonic drill head. In addition, the drill head can be configured to rotate and transmit vibratory energy to the drill string.

A method for making a drill rod can include providing a drill rod configured for sonic drilling operations. In particular, a manufacturer practicing the method can configure the drill rod to include a helical feature along the outer surface of the drill rod. Furthermore, the manufacturer can configure the helical feature to move material displaced by a drilling process in an axial direction away from the end of the drill rod closest to a drill bit Additional implementations of the invention will be set forth in the description which follows, and in part will be obvious from the description, or may be learned by the practice of such examples. The implementations may be realized and obtained by means of the instruments and combinations particularly pointed out in the appended claims.

BRIEF DESCRIPTION OF THE DRAWINGS

In order to describe the manner in which the above-recited and other embodiments of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION OF THE PREFERRED EMBODIMENTS

Drill rods and drilling systems are provided for use in sonic drilling practices, including their methods of use and manufacture. In particular, the present disclosure extends to sonic drilling systems including a drill rod with external features configured for transporting drilled material away from a drill bit to improve drilling efficiencies, penetration rates, and core sample quality. For example, in at least one embodiment, a drill rod used in sonic drilling can include helical features along the exterior surface of the drill rod. A manufacturer can configure the helical features for transporting material in an axial direction away from a bit face and towards the surface or opening of a borehole.

Accordingly, the drill rod can help lift, move, and/or sweep drilled material out away from the bit face and core barrel entrance, thereby aiding in obtaining higher quality samples and in increasing the efficiency of the drilling process. In particular, the system can prevent material from being redrilled; from accumulating in the annular spaces between the drill bit, core barrel, casing, and the borehole wall; and from being forced out into the formation.

As a result, by effectively and efficiently removing the bit face material, the drill rod not only minimizes or prevents core sample disturbance, but also facilitates faster and more efficient drilling. In particular, the drilled material is simply pushed out and then lifted away from the bit face as opposed to being redrilled, compacted, and otherwise forced into undesirable locations, where it can cause excessive friction and heat and/or bind drill bits, core barrels, and casings.

Figure 1:
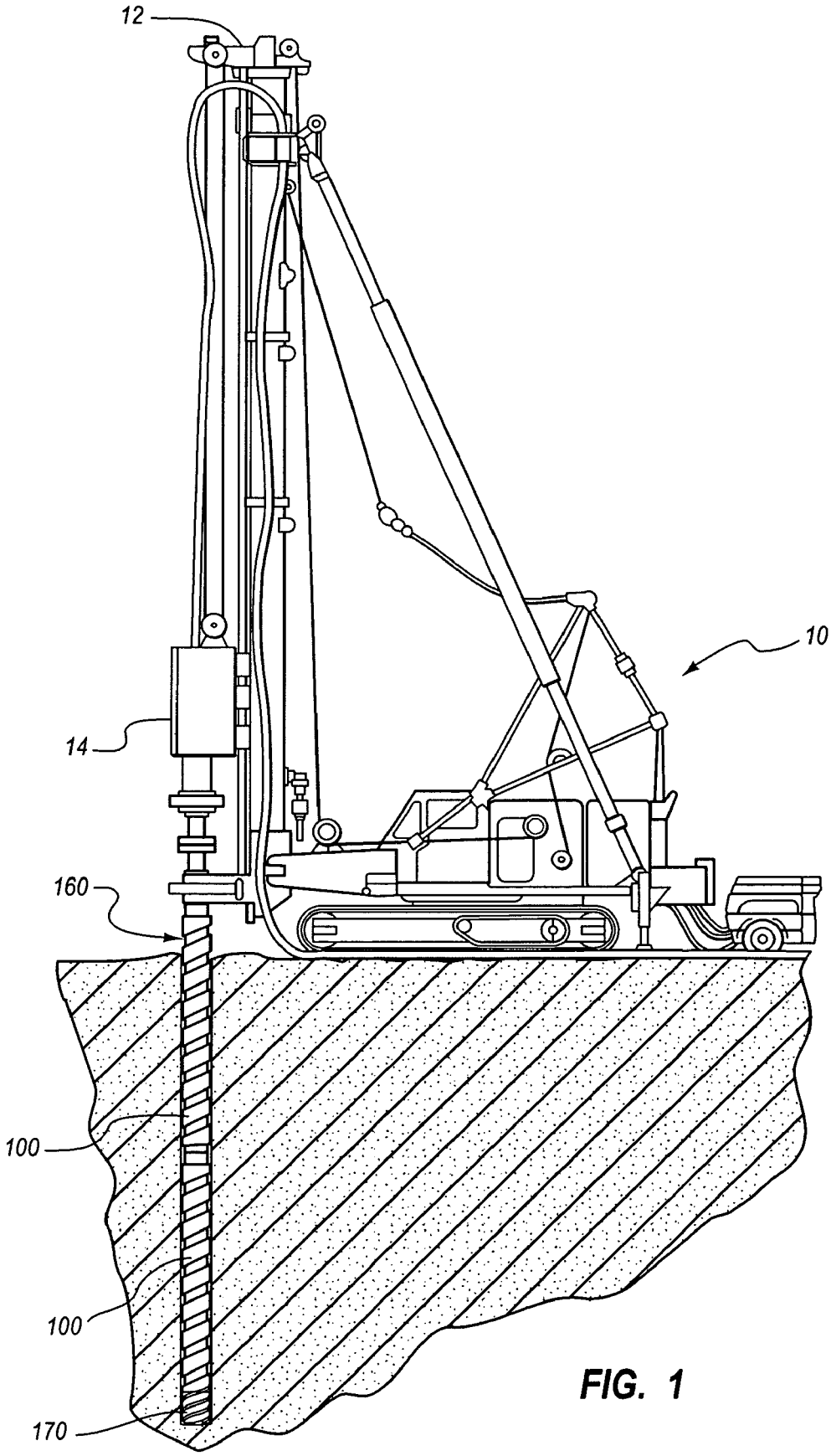
FIG. 1 illustrates a perspective view of a drilling system in accordance with one example embodiment.

Referring now to the figures, FIG. 1 illustrates a perspective view of a sonic drill rig 10 in accordance with one example. In particular, the sonic drill rig 10 can include a mast 12 and a drill head 14. As shown, a drill rod 100 can be coupled to the drill head 14 for drilling a borehole. The drill rod 100 can in turn couple with additional drill rods 100 to form a drill string 160. In turn, the drill string 160 can be coupled to a drill bit 170 configured to interface with the material to be drilled.

In at least one example embodiment, the drill head 14 illustrated in FIG. 1 can include rotating counterbalances (not shown) or other oscillating means configured to vertically vibrate the drill string 160 and, in turn, the drill bit 170. In particular, rotation of the counterbalances of the drill head 14 can produce resonant energy waves transmitted along the length of the drill string 160 to the drill bit 170. In addition, a drill operator can control the rotational frequency of the counterbalances to achieve the vibration desired for a particular borehole. In at least one implementation, the rotational/vibratory frequency of the drill head 14 can range from about 50 Hz to about 180 Hz or more.

In addition to transmitting vertical vibrations to the drill string 160, the drill head 14 can also rotate the drill string 160 during the drilling process. In particular, the rotational rate of the drill string can be varied as desired during the drilling process. In at least one implementation, the rotational rate of the drill string 160 can increase to increase the rate at which drilled material is translated in an axial direction away from the bit face to improve drilling efficiencies and penetration rates. Furthermore, the drill rods 100 and/or drill bits 170 can include features along at least a portion of the outside surface to facilitate the translation of drilled material away from the bit face. Although FIG. 1 illustrates a particular drill rig configuration, any number of different types of drill rigs and drill rig configurations can be used.

Figure 2:
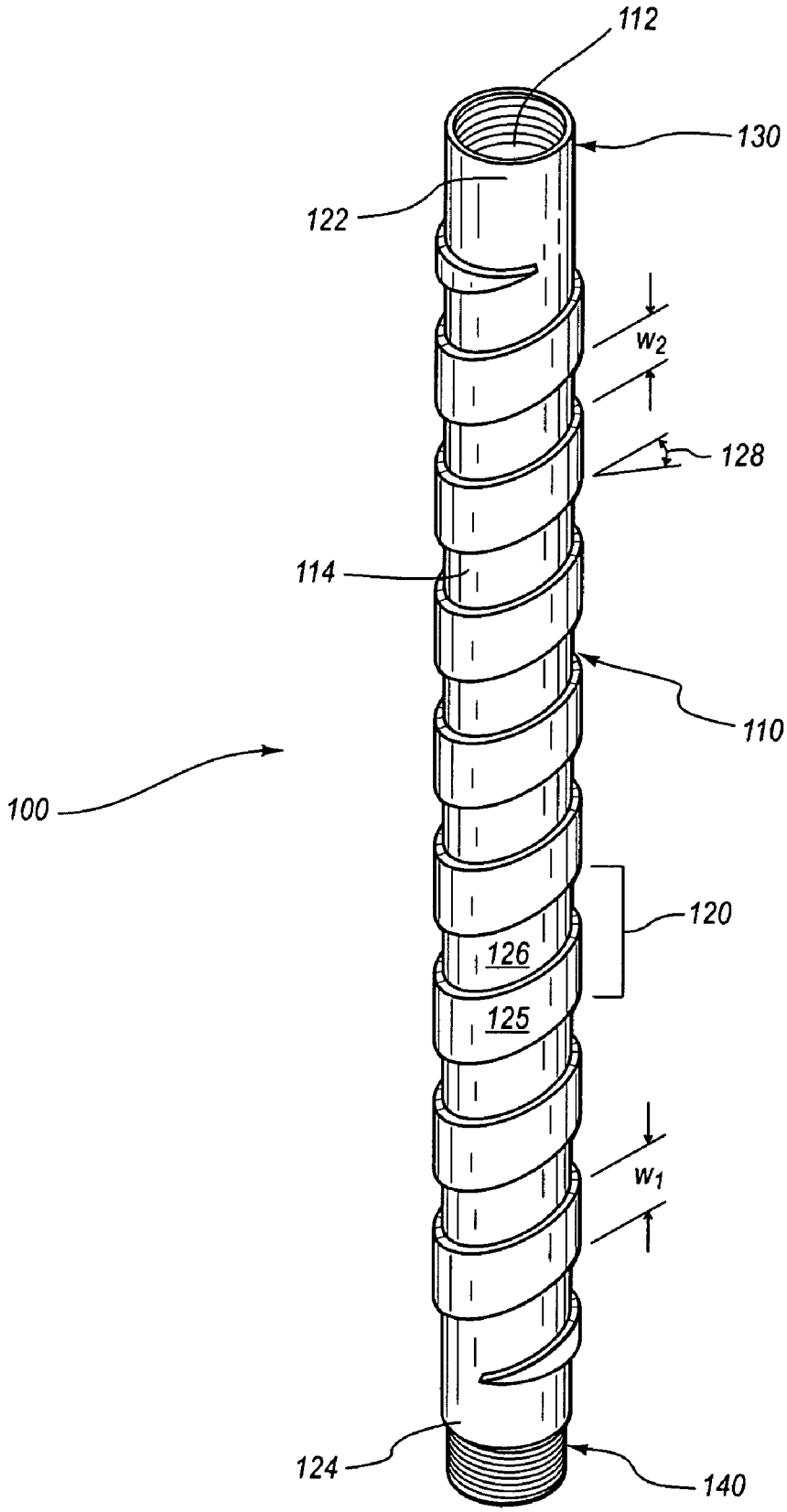
FIG. 2 illustrates a drill rod.

FIG. 2 illustrates a perspective view of a drill rod 100 in accordance with one example embodiment. As illustrated, the drill rod 100 can include an elongated body 110. As shown, in at least one example, the body 110 of the drill rod 100 can be generally cylindrical or pipe-like in shape. In particular, the body 110 of the drill rod 100 can be hollow and include an interior surface 112 and an exterior surface 114 with corresponding inside and outside diameters.

As is further illustrated, a manufacturer can configure the drill rod 100 to include one or more external features 120 along the exterior surface 114 of the body 110. In particular, a manufacturer can configure the external features 120 for transporting drilled material away from a drill bit (e.g., 170, FIG. 1). For example, the external features 120 can include a helical feature 125 spiraling around the exterior surface 114 of the body 110 and extending along the length of the drill rod 100.

In a further embodiment, inclusion of a helical feature 125 creates a corresponding channel 126 or recess on the exterior surface 114 of the drill rod 100. In particular, the channel 126 can also spiral around and extend along the length of the drill rod 100. In at least one example, the external features 120 include multiple helical features 125 and multiple channels 126. In a yet further embodiment, the channel 126 can contain displaced material from the drilling process. In particular, the displaced material can travel upwards through the channel 126 along the length of the drill rod 100. In a still further embodiment, the channel 126 the drill rod 100 can define a segment of a continuous void from one end of a drill string (e.g., 160, FIG. 1) to the other, such that drilled material can travel along the entire length of the drill string (e.g., 160, FIG. 1) to the surface.

As further illustrated in FIG. 2, the drill rod 100 can comprise a box end 130 and a pin end 140. In particular, the box end 130 and pin end 140 can be configured to allow connecting multiple drill rods 100 together to form a drill string (e.g., 160, FIG. 1). For example, in at least one example, the box end 130 can include internal threading and the pin end 140 can include complementary external threading. As a result, a drill string (e.g., 160, FIG. 1) can be formed by screwing multiple drill rods 100 together at the ends. In further embodiments, the box end 130 and pin end 140 can be configured to be coupled together by any design or process known to those of skill in the art.

In addition, the helical feature 125 can extend along the entire length of the body 110 including the box end 130 and up to the threads of the pin end 140. However, in further embodiments, the helical feature 125 can extend along only a portion of the length of the drill rod 100, ending before the box end 130 and/or the pin end 140. As a result, void areas 122, 124 can exist at the portions of the drill rod 100 absent the helical feature 125. In the embodiment illustrated in FIG. 2, the void areas 122, 124 are located at the ends of the drill rod 100.

In a yet further embodiment, the void areas 122, 124 can result in a transition area (e.g., 135, FIG. 4) between two adjacent drill rods 100. In particular, the transition area (e.g., 135, FIG. 4) can facilitate the transfer of drilled material from one drill rod 100 to the next drill rod 100 in a drill string (e.g., 160, FIG. 1). In one embodiment, the transition area (e.g., 135, FIG. 4) can prevent/minimize blockage between the channels 126 of adjacent drill rods 100 where one drill rod 100 transitions to the adjacent drill rod 100 in a drill string (e.g., 160, FIG. 1).

A manufacturer can configure the void areas 122, 124 to have any length that will provide the transition area (e.g., 135, FIG. 4) desired. In particular, the length of the one or more void areas 122, 124 can range from 0 to about 60 inches. In at least one embodiment, the lengths of the void areas can be about 3 inches. Furthermore, although FIG. 2 illustrates the void areas 122, 124 being located at the ends of the drill rods 100, one will appreciate that, in at least one implementation, void areas can be located intermittently along the length of the drill rod 100.

FIG. 2 also illustrates that the helical feature 125 of the drill rod 100 can angle upwards so as to spiral from the pin end 140 to the box end 130. Correspondingly, the channel 126 can also extend upwards on the same angle as the helical feature 125. As a result, one will appreciate that as the drill rod 100 rotates, drilled material located within the channel 126 can translate upwards from the pin end 140 to the box end 130 of the drill rod 100. In addition, each drill rod 100 in a drill string (e.g., 160, FIG. 1) can include a similar external features 120, such that material can translate upwards along the entire length of the drill string (e.g., 160, FIG. 1) as the drill string (e.g., 160, FIG. 1) rotates during the drilling process.

The angle of the helical feature 125 and/or channel 126 with respect to a horizontal plane may be referred to herein as the rake angle 128 or pitch. One will appreciate that the helical feature 125 and/or channel 126 can have any rake angle 128 desired to translate drilled material up through the channel 126 and away from the bit face. In particular, the rake angle 128 can range from 1 to 89 degrees. In at least one example, the rake angle 128 between about 20 and about 50 degrees. In a further example, the rake angle 128 is approximately 30 degrees.

As also illustrated in FIG. 2, the helical feature 125 can have a width $w_1$ and the channel 126 can have a width $w_2$. The helical feature 125 and/or channel 126 can have any widths $w_1$, $w_2$ desired for a particular application. In particular, the helical feature 125 can have a width $w_1$ greater or smaller than the width $w_2$ of the channel 126. For example, the ratio between the channel 126 width $w_2$ and helical feature 125 width $w_1$ can be varied to any dimension in order to create the necessary or desired channel 126 volume along the length of the drill rod 100 to effectively remove drilled material. In at least one embodiment, the ratio of the width $w_1$ of the helical feature 125 to the width $w_2$ of the channel 126 can range from 1:10 to 10:1. In a still further embodiment, the widths $w_1$, $w_2$ can each independently range from 0.1 to 10 inches.

Similarly, a manufacturer can configure the helical feature 125 to wind around the drill rod 100 any number of times as desired. One will appreciate, of course, that the number of times that a helical feature 125 winds around a given length of a drill rod 100 depends largely on the rake angle 128 and width $w_1$ of the helical feature 125, and the diameter of the drill rod 100. In particular, the helical feature 125 and the drill rod 100 can be configured to achieve any desired frequency at which the helical feature 125 winds around the drill rod 100.

Figure 3:
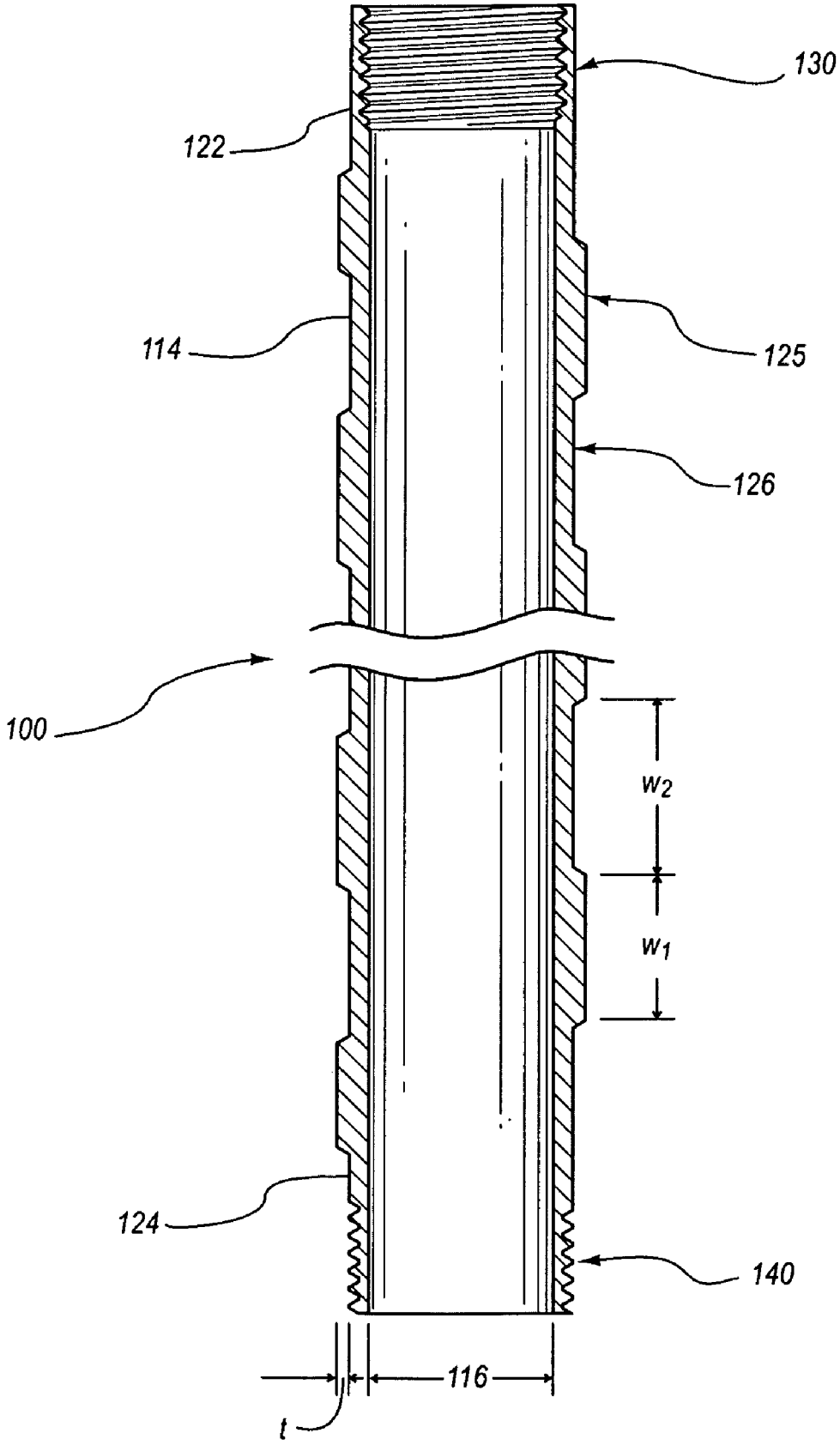
FIG. 3 illustrates a cross-sectional view of the drill rod of FIG. 2.

Furthermore, the helical feature 125 and channel 126 can have a variety of different size and shape configurations as desired for different drilling situations. FIG. 3 illustrates a cross-sectional view of the drill rod 100 of FIG. 2. As illustrated in FIG. 3, the helical feature 125 has a shape and size similar to that of a helical band wrapped around the body 110 and winding along the length of the drill rod 100. In particular, the helical feature 125 has a polygonally-shaped cross-section that is roughly rectangular in shape. The polygonally-shaped helical feature 125 illustrated has a width $w_1$ greater than its thickness t. Accordingly, in at least one implementation, the ratio of the width $w_1$ to the thickness t can be greater than 1:1. In a further embodiment, The ratio of the width $w_1$ to the thickness t can also be at least 3:1 or greater.

However, one will appreciate that the helical feature 125 can vary in size, shape, and configuration as desired. For example, the width $w_1$, thickness t, and rake angle 128 of the helical feature 125 can have any dimension and/or configuration in order to effectively transport or elevate drilled material up the channel 126 along the outside surface of the drill string (e.g., 160, FIG. 1). In at least one example, the helical feature 125 can have a thickness t (which can be substantially similar or equal to the depth of the channel 126) greater than its width $w_1$. In a further embodiment, the thickness t can range from between 0.01 and 1 inches. In a still further embodiment, the thickness t can be approximately 0.25 inches.

Furthermore, although the helical feature 125 illustrated in FIG. 3 has an approximately rectangular cross-section, one will appreciate that the helical feature 125 can be configured as desired to incorporate any of a number of different cross-sectional shapes. For example, in a further embodiment, the cross section of the helical feature 125 can be triangular in shape. In addition, although FIG. 3 illustrates a helical feature 125 having polygonal cross-section with angular edges, in a yet further embodiment, the helical feature 125 can be more rounded and/or semi-circular in shape.

As further illustrated in FIG. 3, the inside diameter 116 of the drill rod 100 can be significantly greater than the thickness t of the helical feature 125. In at least one example, the inside diameter 116 can range from about 1 inch to about 36 inches. In a further embodiment, the inside diameter is about 5 inches.

The drill rod 100 may be manufactured using any known process in the art. For example, a manufacturer can make the drill rod 100 by machining a pipe having a wall thickness in excess of the thickness t of the helical feature 125. In particular, the machining action can cut the channel 126 into the body 110, leaving a helical feature 125 extending from body 110. A manufacturer can then machine the box end 130 and the pin end 140 into the drill rod 100 as known in the art.

One will appreciate, of course, that any number of other methods can be employed for including the helical features 125 into the drill rod 100. For example, in a further example, a manufacturer can assemble the drill rod 100 from various components. In particular, the box end 130, pin end 140, and helical feature 125 can be manufactured as separate components and then coupled to the body 110 of the drill rod 100 by welding or by any other joining means known in the art.

As a result, in at least one embodiment, the different components of the drill rod 100 can be made of different materials. For example, the helical feature 125 may be made of a material different than body 110 of the drill rod 100. In particular, the helical feature 120 can be made of a harder material than the material used for the body 110 in order to add strength and reduce wear to the drill rod 100.

Figure 4:
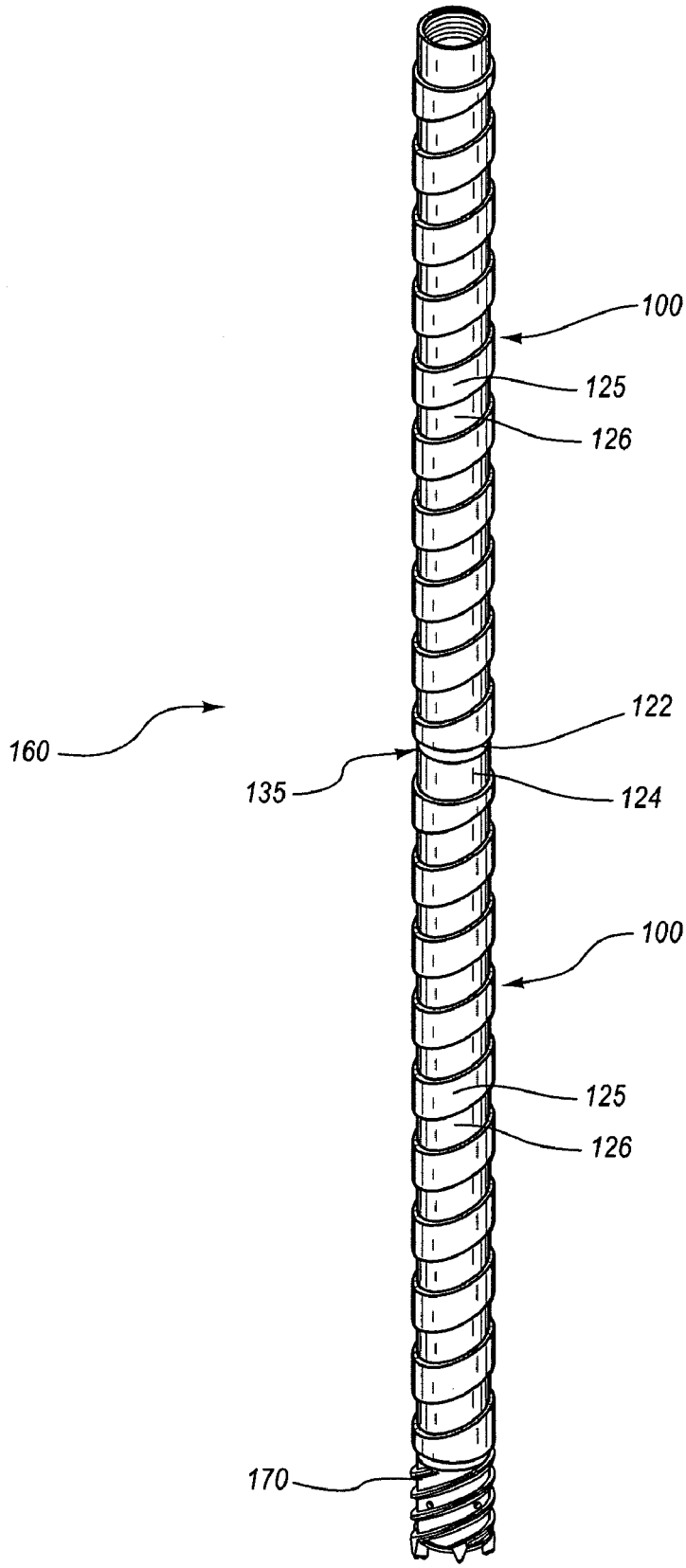
FIG. 4 illustrates a drill string including multiple drill rods and a drill bit.

FIG. 4 illustrates a perspective view of a drill string 160 in accordance with one example. As shown, the drill string 160 includes multiple drill rods 100 and a drill bit 170. A drill operator can use the illustrated drill string 160 in a drilling process to penetrate into a surface by any combination of rotation, pressure, and/or vibration. During the drilling process, material displaced by the drill bit 170 can be conveyed to the helical channel 126, as described in co-pending U.S. Provisional Patent Application Ser. No. 61/052,914, titled "Sonic Drill Bit for Core Sampling" (filed May 13, 2008), the disclosure of which is incorporated herein, in its entirety, by reference. Thereafter, the helical feature 125 can convey the displaced material away from the drill bit 170. In particular, the displaced material can travel upwards along the channel 126 from the drill bit 170 to the surface. Specifically, in one embodiment, the helical feature 125 can move the displaced material upwards through the channel 126 as the drill string 160 rotates.

As further illustrated by FIG. 4, the drill string 160 can contain a transition area 135 where the two drill rods 100 are connected. In particular, the transition area 135 can occur where the void area 122 of one drill rod 100 couples with the void area 124 of an adjacent drill rod 100. As a result, in at least one implementation, displaced material can transition from the channel 126 of one drill rod 100 to the channel 126 of the adjacent drill rod 100 by traveling through the transition area 135.

Embodiments of the present invention can be used in any known drilling process, including sonic drilling processes. In conventional drilling processes for exploration, as discussed above, the drill string (e.g., 160), comprising one or more drill rods (e.g., 100) with helical features (e.g., 125) and helical channels (e.g., 126), can connect to a core barrel having a drill bit (e.g., 170) at its end. An outer casing can comprise a wider-diameter drill string (e.g., 160) (containing a series of wider-diameter drill rods) which can in turn connect to its own drill bit (e.g., 170). As a result, a drill operator can use the casing to maintain a borehole, as is known in the art. Once a casing is in place, the drill operator can trip a core barrel and its corresponding drill string into the borehole and advance the core barrel ahead of the casing to retrieve a core sample. In addition, the core barrel itself can also include one or more helical features (e.g., 125) on the outer surface.

In a further embodiment, implementations of the present disclosure can be used in wireline drilling processes. For example, a drill rod (e.g., 100) having a helical feature (e.g., 125) along the outer surface can be part of a casing with a core barrel latched inside the casing. As a result, a drill operator can simultaneously advance the casing and the core barrel together through a formation. Using a wireline process, as known in the art, the drill operator can trip the inner core barrel in and out of the drill string to obtain core samples from the core barrel.

In either case, whether conventional or wireline drilling processes are employed, implementations of the present disclosure can aid in removing displaced material from the end of the core barrel and/or casing, thereby improving the ability to secure a representative core sample without any elongation or contamination from displaced material. In particular, during the drilling process, the helical features (e.g., 125) along the exterior of a drill string (e.g., 160) can transport material displaced by the drilling process in an axial direction (towards the surface), thereby decreasing the chances for the displaced material to disturb the core sample. In addition, by efficiently and effectively removing displaced material away from the bit face, implementations of the present disclosure prevent/minimize excessive heat caused by redrilling drilled material and by packing displaced material into annular spaces between the formation and the drilling components. As a result, the helical features (e.g., 125) can improve the drilling efficiencies and penetration rates of the drilling process, because the displaced material is lifted away from the drill bit (e.g., 170) as opposed to the wasted time and energy that can be expended while re-drilling, compacting, and/or otherwise forcing the displaced material into undesirable locations, where it can disturb or contaminate the core sample, cause additional friction and heat, and/or cause the core barrels and casings to bind and stick.

The present disclosure supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description includes examples of sonic core drilling, the apparatus and associated methods could be equally applied in other drilling process, such as core drilling, percussive drilling, and rotary drilling, as well as other drilling procedures and systems. Indeed, the apparatus and associated methods could be used in any type of drilling process where displaced material needs to be transported along the length of a drill rod. The term "drill rod" will be taken to include all forms of elongated members used in the drilling, installation, and maintenance of boreholes and wells in the ground and will include rods, pipes, tubes and casings which are provided in lengths and are interconnected to be used in a borehole.

In addition to any previously indicated modification, numerous other variations and alternative arrangements may be devised by those skilled in the art without departing from the spirit and scope of this disclosure. The appended claims are intended to cover such modifications and arrangements. Also, as used herein, examples are meant to be illustrative only and should not be construed to be limiting in any manner.

The invention claimed is:

1. A drill rod configured to be used for sonic drilling operations, the drill rod comprising:

a rigid cylindrical body having an interior surface and an exterior surface; and a helical feature and a corresponding helical channel on the exterior surface of the cylindrical body, wherein:

the helical feature has a first width and a thickness, the first width being defined by a distance the helical feature extends axially along the cylindrical body between portions of the helical channel, and the thickness being defined by a distance the helical feature extends radially outward from the cylindrical body, a ratio of the first width to the thickness is about 3:1 or greater, the helical channel has a second width defined by a distance the helical channel extends axially along the cylindrical body between portions of the helical feature, and the helical channel has a uniform depth, the second width is greater than the first width, and the helical feature and corresponding helical channel are configured for moving material displaced during a drilling operation in an axial direction away from one end of the drill rod to the other.

2. The drill rod as recited in claim 1, further comprising a first connector on a first end of the cylindrical body and a second connector on a second end of the cylindrical body.

3. The drill rod as recited in claim 2, wherein the first connector and the second connector are complementary.

4. The drill rod as recited in claim 1, further comprising multiple helical features and multiple helical channels.

5. The drill rod as recited in claim 1, further comprising at least one void area.

6. The drill rod as recited in claim 5, wherein the at least one void area is in communication with the helical channel.

7. The drill rod as recited in claim 5, wherein the at least one void area is located at an end of the drill rod.

8. The drill rod as recited in claim 1, wherein the helical feature is configured to transport drilled material in an axial direction away from the drill bit.

9. The drill rod as recited in claim 1, wherein the helical channel is configured such that drilled material can be transported away from the drill bit through the channel in an axial direction as the drill rod rotates.

10. The drill rod as recited in claim 1, wherein the helical channel has a depth of between about 0.1 and about 1.0 inches.

11. The drill rod as recited in claim 1, wherein the second width of the helical channel is between about 0.1 and about 10 inches.

12. The drill rod as recited in claim 1, wherein the thickness of the helical feature is between about 0.1 and about 2 inches.

13. The drill rod as recited in claim 1, wherein the first width of the helical feature is between about 0.1 and about 10 inches.

14. The drill rod as recited in claim 1, wherein the helical feature has a rectangular cross section.

15. The drill rod as recited in claim 1, wherein the ratio of the first width of the helical feature to the thickness of the helical feature is 3:1.

16. The drill rod as recited in claim 1, wherein a second ratio of an inside diameter of the drill rod to the thickness of the helical feature is greater than about 3:1.

17. The drill rod as recited in claim 5, wherein the drill rod comprises two voids.

18. The drill rod as recited in claim 1, wherein the helical feature has a rake angle between about 20 and about 50 degrees with respect to a plane extending perpendicular to a longitudinal axis of the drill rod.

19. A system for sonic core drilling, comprising:

a drill rig having a sonic drill head;

a rigid drill string coupled to the sonic drill head, the drill string comprising one or more drill rods, wherein at an outer surface of the least one drill rod comprises:

a helical feature having a first width and a thickness, the thickness being defined by a distance the helical feature extends radially outward from the outer surface of the at least one drill rod, and a helical channel having a second width defined by a distance the helical channel extends axially along the outer surface of the at least one drill rod between portions of the helical feature, and the helical channel having a uniform depth, wherein:

the first width is defined by a distance the helical feature extends axially along the outer surface of the at least one drill rod between portions of helical channel, a ratio of the first width to the thickness is greater than about 3:1, and the second width is greater than the first width;

and a drill bit coupled to the end of the drill string opposite the drill head.

20. The system as recited in claim 19, wherein the drill bit includes one or more helical features along its outer surface.

21. The system as recited in claim 19, further comprising a wireline device configured for extracting core samples through a hollow portion of the drill string.

22. The system as recited in claim 19, wherein the sonic drill head is configured to rotate, and transmit vertical vibrations to, the drill string.

23. The system as recited in claim 19, wherein the drill rod further comprises one or more void areas along the length of the drill rod.

24. The system as recited in claim 23, wherein the void areas are part of a transition area between adjacent drill rods in the drill string.

25. A method of drilling, comprising:

connecting a first drill rod to at least one additional drill rod to form a drill string, the first drill rod having at least one helical feature on an outer surface of the drill rod, wherein:

the helical feature has a first width and a thickness, the first width being defined by a distance the helical feature extends axially along the cylindrical body between portions of the helical channel, and the thickness being defined by a distance the helical feature extends radially outward from the cylindrical body, a ratio of the first width to the thickness is about 3:1 or greater, the helical channel has a second width defined by a distance the helical channel extends axially along the cylindrical body between portions of the helical feature, and the helical channel has a uniform depth, the second width is greater than the first width, and the helical feature is configured to move material displaced during drilling in an axial direction away from one end of the drill rod to the other;

connecting a first end of the drill string to a drill bit; and connecting a second end of the drill string to a sonic drill head configured to rotate, and transmit vibratory energy to, the drill string.

26. The method of claim 25, wherein each drill rod further comprises a helical channel corresponding with the helical feature, through which displaced material moves in the axial direction away from the drill bit during the drilling process.

27. The method of claim 25, wherein the helical feature extends along less than an entire length of the outer surface of the drill rod.

28. A method of making a drill rod:

providing a drill rod configured for sonic drilling operations;

further configuring the drill rod to include a helical feature along the outer surface of the drill rod, wherein:

the helical feature has a first width and a thickness, the first width being defined by a distance the helical feature extends axially along the cylindrical body between portions of the helical channel, and the thickness being defined by a distance the helical feature extends radially outward from the cylindrical body, a ratio of the first width to the thickness is about 3:1 or greater, the helical channel has a second width defined by a distance the helical channel extends axially along the cylindrical body between portions of the helical feature, and the helical channel has a uniform depth, the second width is greater than the first width; and configuring the helical feature to move material displaced by a drilling process in an axial direction away from one end of the drill rod to another during a drilling process.

29. The method as recited in claim 28, wherein configuring the drill rod to include a helical feature along the outer surface of the drill rod comprises machining a helical channel into the outer surface of the drill rod.

30. The method as recited in claim 28, wherein configuring the drill rod to include a helical feature comprises attaching the helical feature to the outer surface of the drill rod.

31. The method as recited in claim 30, wherein attaching the helical feature to the outer surface of the drill rod comprises welding the helical feature to the outer surface of the drill rod.

32. The method as recited in claim 30, wherein the helical feature is manufactured using a different material than the material used to manufacture the drill rod.

* * * * *